US009577395B2

(12) United States Patent
Ma

(10) Patent No.: US 9,577,395 B2
(45) Date of Patent: Feb. 21, 2017

(54) UNIVERSAL SOCKET DEVICE

(71) Applicant: Cord-It Limited, Kowloon, Hong Kong (CN)

(72) Inventor: Hing Wai Michael Ma, Hong Kong (CN)

(73) Assignee: Cord-It Limited, Kowloon, Hong Kong (CN)

( * ) Notice: Subject to any disclaimer, the term of this patent is extended or adjusted under 35 U.S.C. 154(b) by 0 days.

(21) Appl. No.: 14/707,467

(22) Filed: May 8, 2015

(65) Prior Publication Data

US 2015/0325968 A1 Nov. 12, 2015

(30) Foreign Application Priority Data

May 8, 2014 (CN) ..... 2014 2 0232816 U

(51) Int. Cl.
*H01R 27/00* (2006.01)
*H01R 31/06* (2006.01)
*H01R 31/08* (2006.01)

(52) U.S. Cl.
CPC ..... *H01R 27/00* (2013.01); *H01R 31/06* (2013.01); *H01R 31/065* (2013.01); *H01R 31/08* (2013.01)

(58) Field of Classification Search
CPC ..... H01R 31/06; H01R 31/08; H01R 27/00; H01R 27/02; H01R 29/02
USPC ..... 439/222, 639, 640, 652.653, 628
See application file for complete search history.

(56) References Cited

U.S. PATENT DOCUMENTS 6,111,772 A * 8/2000 Lee ..... H01R 13/665 363/100
6,211,581 B1 * 4/2001 Farrant ..... G06F 1/266 307/115
7,212,420 B2 * 5/2007 Liao ..... H01R 13/6675 363/146
7,338,328 B2 * 3/2008 Krieger ..... B60R 11/02 439/668
7,798,825 B1 * 9/2010 Pai ..... H01R 31/06 439/131
7,819,701 B2 * 10/2010 Xia ..... H01R 35/04 439/640
2006/0148291 A1 * 7/2006 Bona ..... H01R 31/06 439/172

* cited by examiner

*Primary Examiner* — Abdullah Riyami
*Assistant Examiner* — Harshad Patel
(74) *Attorney, Agent, or Firm* — Alix, Yale & Ristas, LLP

(57) ABSTRACT

A universal socket device comprises a plurality of sockets arranged in one interface panel, and transformer circuits disposed inside a body. The interface panel is arranged on top of the body, while a male connector is arranged on the lower side of the body adapted to connect to the output power. The male connector includes a plug with 8-shaped cross sections, arranged along the outside wall of the body in parallel. The base of the plug is disposed on a bulge protruding from the body, and a plane is arranged on the outer surface of the bulge, where a groove extends following the same direction of the plug. Due to the male connector structure disposed on the lower side of the body, the center of gravity of the socket device is stabilized, and the socket device is easy to plug and use.

2 Claims, 2 Drawing Sheets

UNIVERSAL SOCKET DEVICE

FIELD OF THE INVENTION

The present invention relates to a socket device. More particularly, the invention relates to a socket device that is easy to plug and connect.

BACKGROUND

Universal sockets have been pretty common in the prior art. Usually, their interface panels are arranged with multiplexed interfaces, which may adapt to a plurality of plugs, including European styles, American styles, Chinese styles, Hong Kong-styles and more. However, the existing sockets, especially portable sockets, are usually designed as an integrated module with one whole body, which is impossible to adapt to some special plugs having special characters, such as the 8-shaped plug of Apple Inc.

Therefore, the prior art needs to be improved and developed.

SUMMARY

The technical problem to be solved in the present invention is, aiming at the defects of the prior art, providing a universal socket device in order to solve the problem in the prior art, that it is inconvenient to adapt to some special plug structures.

The technical solution of the present invention to solve the said technical problems is as follows:

A universal socket device comprises a plurality of sockets arranged in one interface panel, and transformer circuits arranged inside a body. The said interface panel is arranged on top of the body, while a male connector is arranged on the lower side of the said body and adapted to connect to the output power from an adaptor of Apple Inc. The said male connector includes a plug with 8-shaped cross sections, arranged along the outside wall of the body in parallel. The base of the plug is arranged on a bulge protruding from the said body. A plane is arranged on the outer surface of the bulge, where a groove is arranged following the same direction of the plug.

The universal socket device, wherein at least one USB interface is arranged on the side of the said cylinder, is DC-powered by the transformer circuit.

The universal socket device also comprises intermediaries, whose one end is arranged with a female connector, adapted to plugging to the male connector, while the other end is arranged with a new male connector, whose structure is the same as the male connector.

The universal socket device comprises at least one USB interface arranged in the intermediary.

The universal socket device comprises a top surface of the intermediary which is disposed lower than the height of the interface panel.

The universal socket device preferably comprises a body which is a cylinder.

The universal socket device preferably comprises a cylinder arranged to be two parts, which are relatively rotatable while the interface panel is arranged on one of the two parts.

The universal socket device results from adopting a special socket structure arranged on the lower side of the body wherein the center of gravity of the socket device is stabilized, and the socket device is convenient to plug and use.

DETAILED DESCRIPTION

Further detailed descriptions of embodiments of the present universal socket device are stated below. The examples of the embodiments are shown in the attached drawings, wherein, the same or similar signs throughout represent the same or similar components, or those with the same or similar functions. The detailed embodiments described herein, referencing to the attached drawings, are examples used to explain the present invention, instead of limiting the present invention.

In the descriptions of the present invention, it should be understood that terms indicating orientation or position relationships, such as "upper", "lower", "front", "rear", "left", "right", "top", "bottom", "inside", "outside", are those relationships based on the attached figures, which is applied to facilitate describing the present invention conveniently or simplifying the descriptions, instead of indicating or implying that the pointed apparatus or components must have particular orientations, or must be constructed and operated in the particular orientations, and therefore, it should not be understood as limiting the present invention.

In the present invention, unless otherwise clearly defined and limited, terms including "mounted", "connecting", "connected", "fixed" should be understood broadly. For example, it may be fixed connections, or detachable connections, or integrated connections; it may be mechanical connections, or electrical connections; it may be direct connections, or indirect connections through intermediaries; it may be interconnections inside two components, or the interactions between two components. Ordinary technical personnel in this field can understand the specific meanings of the above mentioned terms based on the specific conditions in the present invention.

Figure 1:
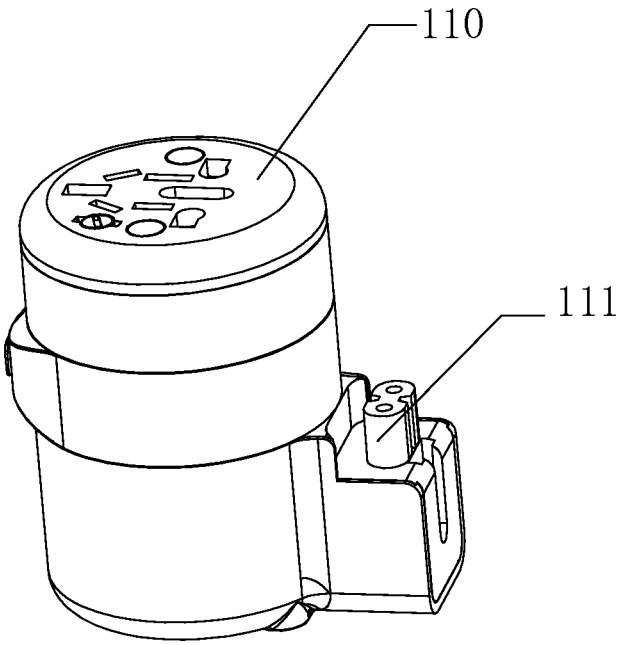
FIG. 1 illustrates a perspective diagram of a preferred embodiment of the socket device.
Figure 2:
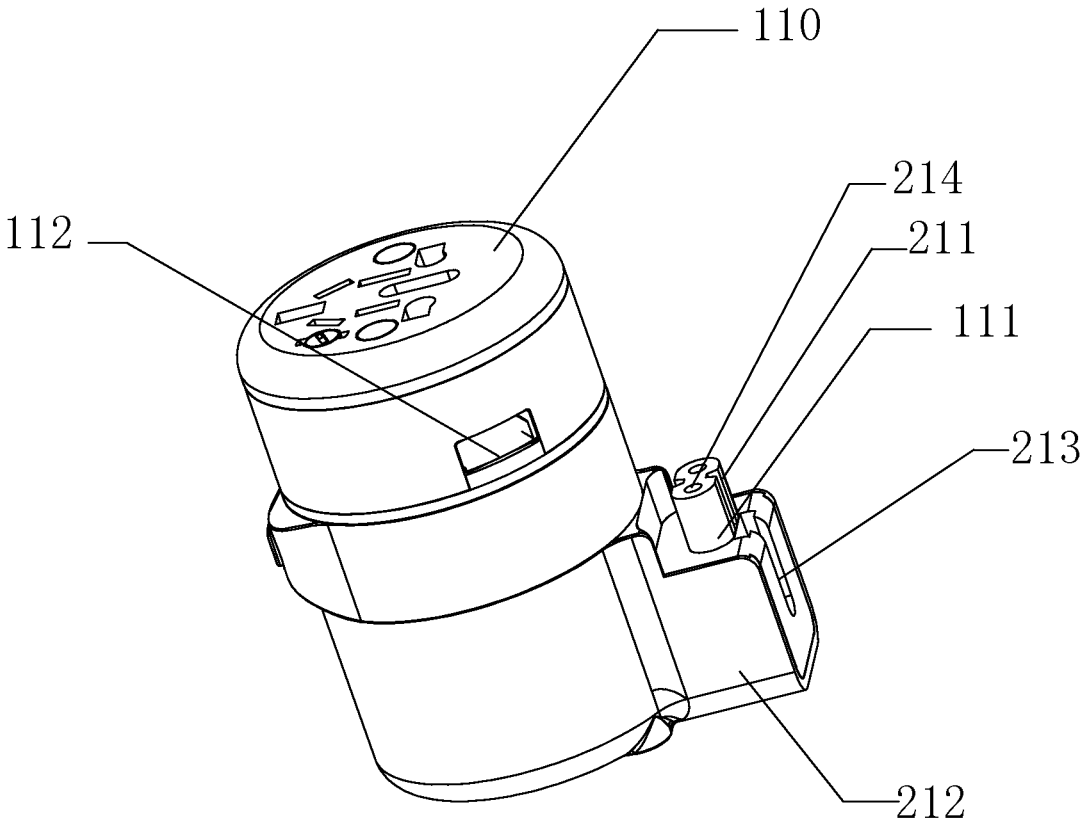
FIG. 2 illustrates a perspective diagram of a preferred embodiment of the socket device from another point of view.

Detailed descriptions of preferred embodiments are stated below:

For the universal socket device shown in FIG. 1 and FIG. 2, the major configuration contains a body, which may be but is not limited to a cylinder. For example, it may be square shaped, rectangular shaped or else. An interface panel 110 is arranged on the top, while transformer circuits are arranged inside the outer shell of the cylinder, which belongs to the current technologies and will not be described in detail herein. The interface panel 110 is designed to contain a plurality of sockets to adapt a plurality of plug styles, including American styles, European styles, Hong Kong styles, Chinese styles and more.

The lower side of the cylinder in the socket device is configured to be a male connector structure 111, adapted to plug and connect the MAGSAFE™ adaptor from Apple Inc., shown in FIG. 2. Specifically, it is a boss plug 211 with two or three interfaces, arranged following the outer wall of the body in parallel. Jacks 214 are arranged in the boss plug accordingly. Preferably, it is configured to be a plug 211 with 8-shaped cross sections, while the base of the said plug 211 is disposed on a bulge 212 protruding from the side of the body. A plane is arranged on the outer surface of the said bulge 212. A groove 213 is arranged in the plane extending in the same direction of the plug.

Figure 3:
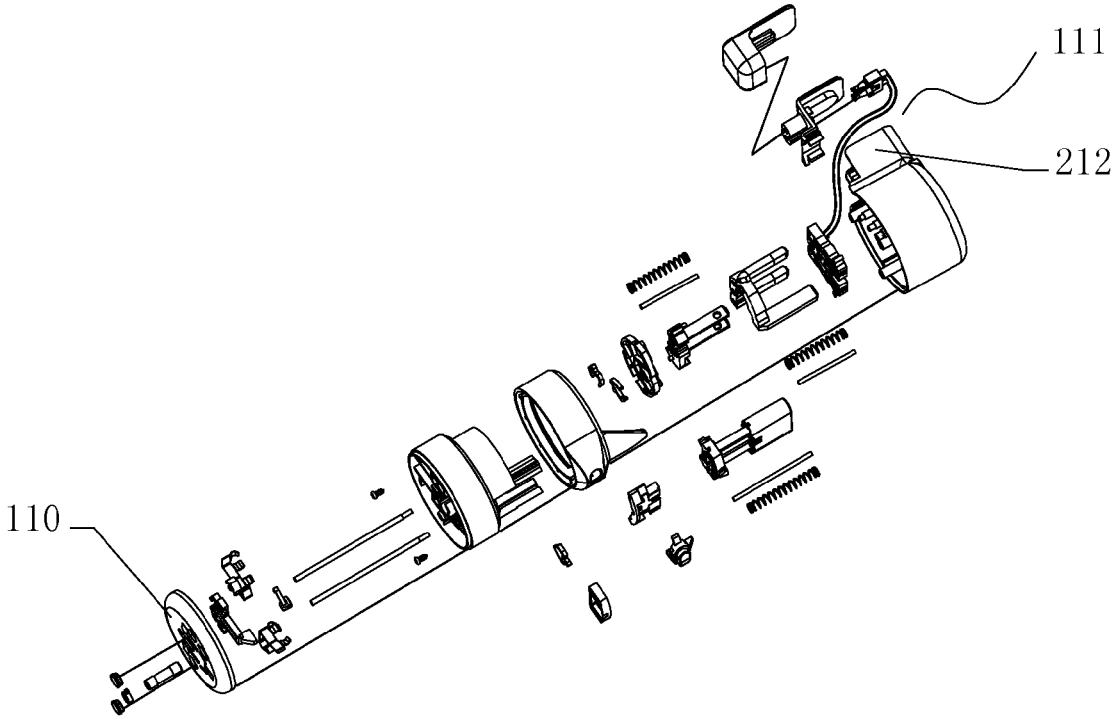
FIG. 3 illustrates an exploded diagram of a preferred embodiment of the socket device.

At least, but not limited to, one USB interface 112 may be arranged on the side wall of the cylinder. The USB interface 112 is DC powered by a transformer circuit. However, the USB interface is not a must configured structure. Different USB adaptors may be configured based on different requirements. An exploded diagram of a preferred embodiment on the socket device described is shown in FIG. 3. The implementation of the body structure has been already known in the prior art, and thus will not be described in detail. It is an interface panel 110 on the top of the said body, and a bulge 212 arranged on the lower part of the body, where a corresponding male connector structure 111 is disposed.

The arrangement of both male connector structure and the circuit thereof on the lower part, ensures the center of gravity of the socket device is disposed at a lower position. Meanwhile, at least one intermediary may be arranged (which is not shown in the figure), whose two sides are arranged respectively with a corresponding new male connector and a female connector adapting for plugging to the said male connector. Therefore, it is possible to arrange a plurality of intermediaries overlapping each other, plugging and connecting both male and female connectors in a sequence, and at least one USB interface may be arranged on the side of each intermediary. Preferably, three USB interfaces may be arranged. In such a way, a plurality of overlapping sockets may be formed, and it is very convenient to expand the power interfaces.

More preferably, the universal socket device provided herein may arrange the said cylinder into two parts, which are relatively rotatable, and the interface panel is also rotatable relative to the bottom. Specifically, the said USB interface is rotatable relative to the bottom. Therefore, the rotation facilitates according to the insertion of different plugs.

In order to facilitate the usage of the interface panel, for example, the Hong Kong-styled standard plugs are usually a triangle set of square-shaped arms, and the wire is arranged downward. Therefore, for plugging and connecting conveniently, the height of the top surface of the said intermediary should be lower than that of the interface panel.

The universal socket device provided is convenient for users to use, and may overlap a plurality of intermediaries, and thus achieve more interface expansions.

It should be understood that, the application of the present socket device is not limited to the above-listed examples. One of ordinary skill can improve or change the applications according to the above descriptions. All of these improvements and transformations should belong to the scope of protection in the appended claims.

The invention claimed is:

1. A universal socket device comprises body, a plurality of different sockets arranged in one interface panel, and transformer circuits arranged inside the body wherein the said interface panel is arranged on top of the body, said body being a cylinder arranged in two parts which are relatively rotatable and the said interface panel is arranged on one of the two parts and a male connector is arranged on a lower side of the body and adapted to connect to the output power from an adapter, the male connector including a plug extending in a first direction with an 8-shaped cross section arranged along an outside wall of the body, the base of the plug being disposed in a bulge protruding from the body, and a plane is arranged on the outer surface of the bulge wherein a groove extends in the first direction of the plug.

2. The universal socket device according to claim 1, wherein at least one USB interface is arranged on a side of the body, which USB interface is DC-powered by a said transformer circuit.

* * * * *